United States Patent [19]

Margerum et al.

[11] Patent Number: 4,511,602

[45] Date of Patent: Apr. 16, 1985

[54] THERMAL IMPRINTING OF SUBSTRATES

[75] Inventors: Edward S. Margerum, Salem; Norman A. Hiatt, Framingham, both of Mass.

[73] Assignee: Dennison Mfg. Company, Framingham, Mass.

[21] Appl. No.: 510,510

[22] Filed: Jul. 5, 1983

Related U.S. Application Data

[62] Division of Ser. No. 194,694, Oct. 6, 1980, Pat. No. 4,404,249.

[51] Int. Cl.[3] ..... B41M 5/26

[52] U.S. Cl. ..... 427/148; 156/234; 156/240; 427/177; 427/256; 427/271

[58] Field of Search ..... 156/234, 239, 240, 249, 156/250, 254, 264, 277; 427/148, 177; 428/195, 200, 206, 207, 215, 216, 480, 483, 484, 497, 516, 523

[56] References Cited

U.S. PATENT DOCUMENTS

| | | | |
|---|---|---|---|
| 3,519,511 | 7/1970 | Coover | 156/234 |
| 3,567,571 | 3/1971 | Martinovich | 156/240 |
| 3,852,091 | 12/1974 | Newman | 428/913 |
| 4,294,641 | 10/1981 | Reed et al. | 427/148 |

*Primary Examiner*—Bruce H. Hess

*Attorney, Agent, or Firm*—George E. Kersey; Barry D. Josephs

[57] ABSTRACT

Thermal imprinting of substrates, for example one or more surfaces of multi-dimensional objects, using a heat transfer film formed by a carrier and a release layer of pigmented, low molecular weight polyolefin. The imprint is made by bringing the transfer layer into contact with the surface of an object and applying heat. This releases the transfer layer to the surface being imprinted. When the transfer layer is required to have any significant thickness, it desirably includes a low melting point wax or resin to provide flexibility. The release characteristic can be improved by the inclusion of a further crystalline wax layer between the transfer layer and the carrier.

12 Claims, 5 Drawing Figures

* May also be used for coating less than 0.0002 to increase adhesion (resin) or flowability (wax)

* May also be used for coating less than 0.0002 to increase adhesion (resin) or flowability (wax)

THERMAL IMPRINTING OF SUBSTRATES

This is a division of Ser. No. 194,694, filed 10/6/80, now U.S. Pat. No. 4,404,249.

BACKGROUND OF THE INVENTION

In the thermal imprinting of substrates a carrier with a transfer layer is brought into contact with an object, i.e. substrate, which is to be imprinted. Simultaneously with the contact of the carrier transfer layer with the surface of the object that is to be imprinted, a heated die, i.e. printhead, is brought into engagement with the reverse side of the carrier. This brings about the release of the transfer layer from the carrier to the surface to be imprinted. When the carrier is withdrawn the released transfer layer remains on the object and the imprinting is thus completed.

Thermal imprints are commonly made using heat transfer films which are known as "hot stamp foils", or "roll leaves". The foil or leaf is typically a thin polypropylene or polyester film which is coated with a suitable transfer layer. The result is a laminate made up of the carrier and various layers of the transfer material.

Conventional transfer laminates typically employ at least three functional coatings, but a much larger number of coatings may be used, in some cases as many as eleven. In general the greater the decorative effect that is desired the larger is the number of coatings that is needed.

Representative patents of the prior art include U.S. Pat. Nos. 3,708,320; 3,600,256; 3,666,516; 3,949,139; 3,770,478; 3,770,479; 3,940,864; 4,053,672; 4,084,032; 4,007,067; and 4,047,996.

The prior art transfer laminates for heat transfer films require a significant number of separate layers, typically a separate layer for each of the various functions associated with the laminate. When the transfer film is used in creating a pictorial transfer, it is necessary to include pigment in a pattern. Since the transfer layer has to be releasable it is customary to include a coating that serves primarily a release function. The required inclusion of a large number of different layers in the laminate results in substantial cost and a significant use of materials.

Accordingly, it is an object of the invention to facilitate the production and use of hot transfer films and related heat transfer structures. Another object is to reduce the required number of layers in the laminate needed to accomplish a prescribed set of functions in heat transfer films. A related object is to reduce the cost of producing suitable heat transfer films. Another related object is to reduce the amount of materials required for heat transfer films.

The most common employment of heat transfer films is for making decorative and coding imprintings. The latter consists of a set of alpha numeric characters which carry information about the product that has been imprinted.

Accordingly, it is still another object of the invention to facilitate the imprinting of objects. A related object is to facilitate the coded imprinting of objects.

Heat transfer films are commonly used in the imprinting of hard surfaces, for example, those associated with thermoplastic materials where conventional printing techniques can produce smudging or smear. Heat transfer films are also employed for the imprinting of resilient, non-porous and non-retentive surfaces. They are used to advantage with irregular surfaces where conventional imprints are unsatisfactory.

Accordingly, it is yet another object of the invention to facilitate the imprinting of non-porous, non-retentive and irregular surfaces. A related object is to improve the efficiency with which heat transfer films can be used in the imprinting of resilient, porous, non-retentive and irregular surfaces.

Another important use for heat transfer films is in the decoration of multi-dimensional objects. When conventional inks are used in this situation it is necessary to permit each imprinted surface to dry before any further imprint can be made. In general the conventional imprinting of multi-dimensional surfaces results in characters that tend to be blurred and lack sharpness. Thermal imprints permit high speed operation since there is no need for drying.

Accordingly, it is yet another object of the invention to increase the rate at which multi-dimensional objects can be imprinted. It is another object to achieve increased sharpness of character imprint. Still another object is to enhance the efficiency with which multi-dimensional imprinting can be achieved with heat transfer foils.

SUMMARY OF THE INVENTION

In accomplishing the foregoing and related objects the invention provides a transfer coating which is particularly suitable for heat transfer films and is significantly reduced in complexity as compared with the transfer laminate that is conventionally used with heat transfer films.

In accordance with one aspect of the invention the transfer coating can employ a single layer which serves the same functions that have conventionally required the use of a plurality of individual layers.

In accordance with another aspect of the invention a suitable transfer layer is realized using a pigmented polyolefin of low molecular weight, low softening point and moderate viscosity. Such a polyolefin has significant hardness and low tensile strength with little elongation. This results in the ready removal of pigment from the transfer layer in sharp and solid form. The relatively low softening point and moderate viscosity of the polyolefin aid in dispersion of the pigment. The result is improved imprintability of the pigment in the transfer coating as compared with conventional transfer laminates used in heat transfer films.

When the transfer layer is required to have any significant thickness, it desirably includes a low melting point resin or wax to provide suitable flexibility. In addition the resin can contribute to adhesion, tack and cohesion of the transfer layer.

In accordance with another aspect of the invention a layer of crystalline wax can be included between the transfer layer and the carrier. Crystalline wax can provide improved releasability. In general, a separate release layer is not required and the transfer layer alone has a suitable release characteristic.

In accordance with a further aspect of the invention the pigment employed in the transfer layer provides suitable coloration and opacity. Dyes may be used in place of pigment, but they are less preferred because of their lesser heat and light stability and their inherent transparency.

In accordance with a still further aspect of the invention the low molecular weight polyolefin is a polyethylene resin. It may be used in both emulsifiable and nonemulsifiable form. The molecular weight of a suitable polyethylene resin is below 10,000. The softening point is in the range from 80° to 150° C. The viscosity is below about 20 poises per second.

In accordance with yet another aspect of the invention the resin or wax component that is employed includes hydrocarbons and esters (lipids) of fatty acids and alcohol. They are thermoplastic and have a molecular weight between 250 and 4000.

DESCRIPTION OF THE DRAWINGS

Other aspects of the invention will become apparent after considering several illustrative embodiments taken in conjunction with the drawings in which.

DETAILED DESCRIPTION

Figure 1:
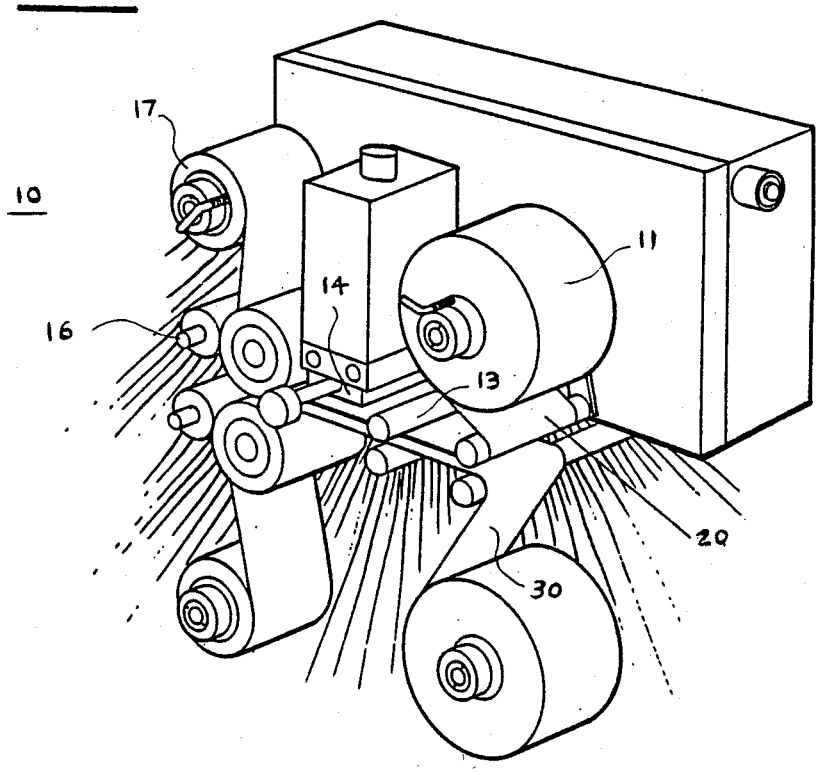
FIG. 1 is a perspective view of a thermal imprinting device for use in accordance with the invention.

With reference to the drawings, a thermal imprinting device for the practice of the invention is shown in FIG. 1. The imprinting device 10 is electromagnetically, or pneumatically operated and electronically controlled. It can be attached and used with packaging machinery. It includes a film roller 11 of heat transfer film which is formed by a thin carrier and a transfer coating of the kind described below. The heat transfer film extends from the roller 11 around a tension roller 12 to a guide roller 13. The film then passes below a type chase 14 to an advance roller 15. From the advance roller 15 the film extends to an advance adjustment roll 16 and then to a takeup roller 17.

Also shown in FIG. 1 is a representative roll 20 of flexible sheeting that is intended to be imprinted using the device 10. After the sheeting of the roll 20 is imprinted it is typically used in making flexible packaging. Acting upon the type chase in the device 10 is a movable head 18. The type chase 14 is removable for replacement with any other suitable arrangement of type set according to the imprint that is to be made on the roll 20.

In operation the film from the supply roller or reel 11 is advanced stepwise across the type chase 14 and the print head is operated to heat the face and bring it into contact with the carrier side of the film, causing the selective release of the transfer layer and the imprint of the roll 20 of flexible material according to the pattern of the type characters set in the face 14. This operation is summarized in FIG. 3B.

A suitable imprinter device 10 is the Metronic Model MO2 Hot Stamp Roll Leaf Printing Machine, which is distributed by the Control Print Packaging Systems Division of the Dennison Manufacturing Company, 67 Sand Park Road, Cedar Grove, N.J.

Figure 2A:
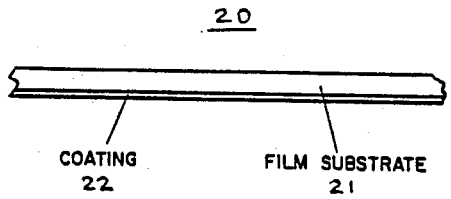
FIG. 2A is a longitudinal cross sectional view of a composite thermal imprinting foil in accordance with the invention.

A longitudinal cross sectional view of the printing film 20 is shown in FIG. 2A. The film 20 includes a carrier 21 with a superimposed transfer layer 22. The carrier 21 is of polyester, for example Mylar film, or of polypropylene. A suitable polyester or polypropylene sheeting has a thickness in the range from 0.5 to 1 mil. The coating 22 can be below 0.0002 inch in thickness and can range in thickness up to 0.002 inch. The coating 22 can be applied to the carrier 21 by extrusion using the type of coater that is commonly employed in hot melt coatings. It can also be applied by gravure, and other methods.

Figure 2B:
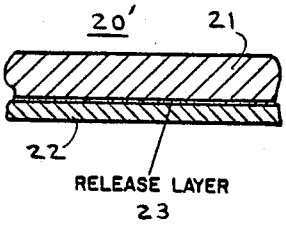
FIG. 2B is a longitudinal cross sectional view of an alternative composite thermal printing foil in accordance with the invention.

In an alternative embodiment of the film 20 shown in FIG. 2B an intermediate release coating 23 is interposed between the sarrier 21 and the transfer coating 22. This coating is desirably of crystalline wax and is used only where a supplemental release layer is desired. Thermal transfer films generally do not require the release coating 23 with the exception of formulations, which do not have a sufficient transfer polymer to provide adequate release.

Figure 3A:
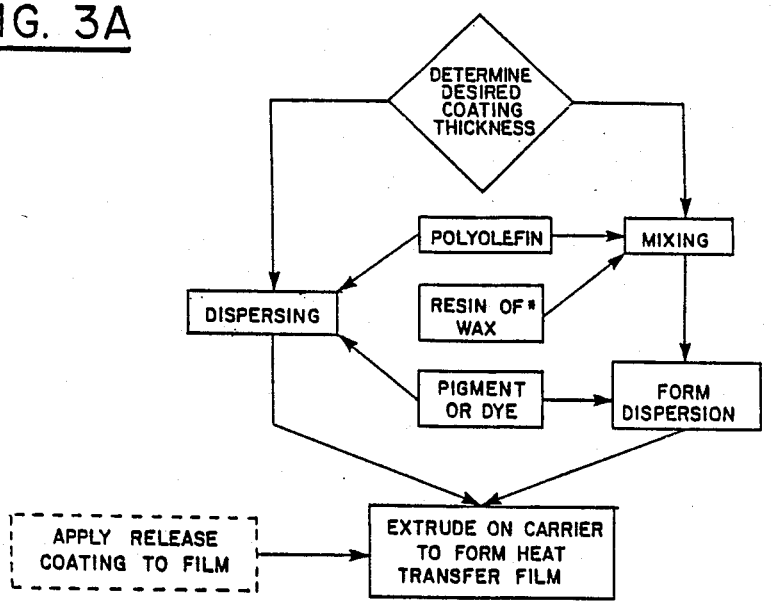
FIG. 3A is a flow chart for the production of a heat transfer film in accordance with the invention.
Figure 3B:
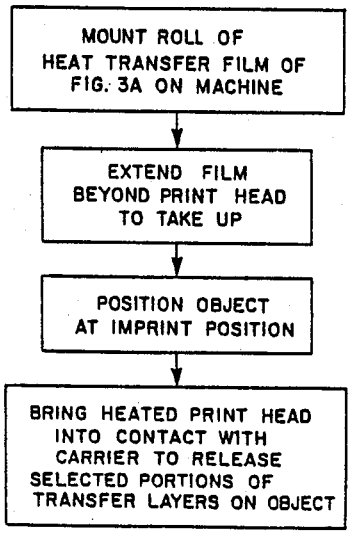
FIG. 3B is a flow chart illustrating the practice of the invention.

The film 11 in accordance with the invention is produced as summarized in FIG. 3A by mixing and dispersing the ingredients that form the transfer coating 22. The coating 22 is then extruded on a suitable film substrate 21. The film is in sheet form, which requires slitting and rewinding to provide the coil 11 pictured in FIG. 1 ready for use in the thermal imprinting device 10. The coating 22 is formed by mixing a pigment into polyolefin of low molecular weight. A suitable polyolefin is low molecular weight polyethylene having a softening point in the range from 80° to 150° C. and a molecular weight below 10,000.

The transfer layers 22 have thickness below about 0.0002 inch. It has been found that the mixture of the polyolefin and pigment are sufficient to provide superior heat transfer imprints. In those applications the amount of pigment varies between 15 and 50 percent and the polyolefin varies between 50 and 85 percent.

When the transfer coating is to have a thickness greater than 0.0002 it has been found desirable to add a low melting point resin. When a resin is employed in the transfer layer 22 the amount ranges up to 20 percent and the pigment and polyolefin are reduced correspondingly.

In some cases the desired flexibility is enhanced by the substitution of wax for the resin or by the mixture of low melting point resin and wax. When waxes are used they can range up to 40 percent of the composition and the other ingredients are modified correspondingly.

In the case of the embodiment which employs a release layer 23 between the film 21 and the transfer layer 22, the wax is a branched chain paraffin characterized by a crystal structure and a higher viscosity than is usually associated with normal wax. Such a wax is obtained by dewaxing tank bottoms and from refinery residues. Its average molecular weight is in the range from about 500 to 800, being about twice that of paraffin. Its viscosity is in the range of from about 45 to 125 cps per second. It has a penetration value in the range from about 3 to 33.

Further aspects of the invention will be appreciated from consideration of the following non-limiting examples:

EXAMPLE I

A low molecular weight polyethylene sold and marketed under the name "Epolene E-12" amounting to 53.4 percent by weight of the final composition is mixed with a low melting point resin sold and marketed under the name "Foral" in an amount constituting 13.3 percent by weight of the final composition. Once the resin and low molecular weight polyethylene have been thoroughly mixed a black pigment sold under the name "Uhlich L-2550" in an amount constituting 33.3 percent of the final composition is dispersed into the mixture of the resin and polymer. The resulting dispersion is extruded at a thickness in the range from 0.002 inch to 0.0002 inch on a polyester film sold under the name Mylar having a thickness of 0.5 mil. The resulting coated sheeting is slit into a "foil" roll of a kind illustrated by the roll 11 in FIG. 1. The roll is then used with the machine of FIG. 1, and the result is a print which is readily removed from the transfer coating and remains sharp and solid with suitable opacity and coloration.

Typical properties of Epolene$^R$ E-12 are summarized in Table I below.

TABLE I

| | |
|---|---|
| Ring and Ball Softening Point, °C. | 112 |
| Penetration Hardness, 100 g/5 sec/25° C., tenths of mm | 1 |
| Density, 25° C. | 0.955 |
| Acid Number | 16 |
| Brookfield Thermosel Viscosity, cP[a] | |
| 125° C. (257° F.) | 250 |
| 150° C. (302° F.) | — |
| 190° C. (374° F.) | — |
| Color, Gardner Scale | 1 |
| Molecular Weight, approximate | 2,300 |

[a]Conventional Brookfield viscosity = 1.15 × Brookfield Thermosel viscosity.

EXAMPLE II

Example I is repeated with one of the following polyethylene substitutes for Epolene$^R$ E-12, having the characteristics summarized in Tables II and III below.

TABLE II

SUMMARY OF CHARACTERISTICS OF OTHER EMULSIFIED EPOLENE ® WAXES

| Type and Number* | E-10 | E-11 | E-14 | E-15 | E-43 | E-45 |
|---|---|---|---|---|---|---|
| Ring and Ball Softening Point, °C. | 106 | 106 | 104 | 100 | 157 | 114 |
| Penetration Hardness 100 g/5 sec/25° C. tenths of mm | 2 | 3 | 4 | 7 | 0.1 | 1 |
| Density, 25° C. | 0.942 | 0.941 | 0.939 | 0.925 | 0.934 | 0.964 |
| Acid Number | 15 | 15 | 16 | 16 | 47 | 18 |
| Brookfield Thermosel Viscosity, cP[a] | | | | | | |
| 125° C. (257° F.) | 900 | 350 | 250 | 350 | b | — |
| 150° C. (302° F.) | — | — | — | — | b | 250 |
| 190° C. (374° F.) | — | — | — | — | 400 | — |
| Color, Gardner Scale | 2 | 2 | 2 | 2 | 11 | 3 |

TABLE II-continued

SUMMARY OF CHARACTERISTICS OF OTHER EMULSIFIED EPOLENE ® WAXES

| Type and Number* | E-10 | E-11 | E-14 | E-15 | E-43 | E-45 |
|---|---|---|---|---|---|---|
| Molecular Weight, approx. | 3000 | 2200 | 1800 | 3400 | 4500 | 2100 |

[a]Conventional Brookfield viscosity = 1.15 × Brookfield Thermosel viscosity.
b Solid at this temperature.
*Type and Number designations are those of the manufacturer.

SUMMARY OF TABLE III

| | N-10 | N-11 | N-12 | N-14 | N-15 | N-34 | N-45 | C-10 | C-13 | C-14 | C-15 | C-16 |
|---|---|---|---|---|---|---|---|---|---|---|---|---|
| Ring and Ball Softening Point, °C. | 111 | 108 | 117 | 106 | 163 | 103 | 123 | 104 | 110 | >133 | 102 | 106 |
| Pentration Hardness, 100 g/5 sec/25° C., tenths of mm | 2 | 2 | 1 | 3 | 0.6 | 5 | 0.1 | 3 | 3 | 2 | 4 | 3 |
| Density, 25° C., g/cc | 0.925 | 0.921 | 0.938 | 0.920 | 0.860 | 0.910 | 0.947 | 0.906 | 0.913 | 0.918 | 0.906 | 0.908 |
| Acid Number | <0.05 | <0.05 | <0.05 | <0.05 | <0.05 | <0.05 | <0.05 | <0.05 | <0.05 | <0.05 | <0.05 | 5[a] |
| Brookfiedl Thermosel Viscosity[b], C$^P$ | | | | | | | | | | | | |
| 125° C. (257° F.) | 1500 | 350 | 450 | 150 | d | 450 | — | — | — | d | — | — |
| 150° C. (302° F.) | — | — | — | — | d | — | 500 | 7800 | — | — | 3900 | 8500 |
| 190° C. (374° F.) | — | — | — | — | 600 | — | — | — | — | — | — | — |
| Melt Index, 190° C. | — | — | — | — | — | — | — | 2,250 | 200 | 1.6 | 4,200 | 1,700 |
| Color, Gardner Scale | 1 | 1 | 1 | 1 | 1 | 1 | 1 | 1 | 1 | 1 | 1 | 1 |
| Molecular Weight[c] | 3,000 | 2,200 | 2,300 | 1,800 | 14,000 | 2,900 | 2,100 | 8,000 | 12,000 | 23,000 | 4,000 | 8,000 |
| Cloud Point,[c] °C. | 85 | 79 | 87 | 77 | 104 | 69 | 97 | 77 | 81 | 84 | 75 | 78 |

[a]Saponification number
[b]Conventional Brookfield viscosity = ~1.15 × Brookfield Thermosel viscosity
[c]2% in 130° F.
[d]Solid at this temperature

EXAMPLE III

Examples I and II are repeated with no more than 10 percent dye, including "Sudan Deep Black BB", BASF, "Nigiosine Base", Ciba Geigy, or Waxoline Red O", ICI, substituted for the pigment. The result is substantially the same as for Example I with reduced opacity of the imprint and less light stability.

EXAMPLE IV

Examples I and II are repeated with "Epolene" replaced by a low molecular weight polyethylene sold and marketed under the name "AC Polyethylene" by the Allied Chemical Company. The results are substantially the same as for Example I.

EXAMPLE V

Examples I and II are repeated with "Epolene" replaced by low molecular weight polyethylene sold under the names "El Rexene" of Northern Petrochemicals, "Rumiten" of Rumianca SPA; "Microthene" and "Petrothene" of USI Industrial. The results are substantially the same as Example I.

EXAMPLE VI

Examples I and II are repeated with the thickness of the transfer coating reduced to below 0.0002 inch and the resin component eliminated. The results are the same as for Example I.

EXAMPLE VII

Example VI is repeated with the polyolefin permitted to vary between 50 and 85 parts by weight and the pigment to vary between 15 and 50 parts by weight. The results are substantially the same as for Example V.

EXAMPLE VIII

Example VI is repeated except that the amount of polyolefin is varied between 50 and 85 parts by weight and the composition includes up to 20 percent resin by weight. The results are substantially the same as for Example V.

EXAMPLE IX

Examples I and II are repeated using at least 25 percent lower melting point polyethylene except that the resin is present in up to 20 percent by weight and is combined with wax up to 40 percent by weight. The pigment varies between 15 and 50 percent and the remainder consists of low melting point polyethylene. The results are the same as for Example I.

EXAMPLE X

Examples I and II are repeated with "Foral" replaced by Pentalyn H or Stabilite Ester 10. Foral, Pentalyn H and Stabalite Ester 10 are rosin esters. The results are the same as for Example I.

EXAMPLE XI

Examples I and II are repeated with "Uhlich L2550" replaced by "Black Pearls A", Cabot, "Perma Black Toner", H. Kohnstamm, or "Peerless 155 Beads", Columbian Carbon. The results are the same.

EXAMPLE XII

Examples I and II are repeated with the colored pigments, "Victoria Blue Lake", H. Kohnstamm, "Napthol Red Light 10397", Sherwin Williams, or "Lincoln Green Y", Allied Chemical, substituted for the black pigment. The results are the same.

EXAMPLE XIII

The foregoing examples are repeated using a carrier of either polyester film or polypropylene film having a thickness in the range from about 0.5 to about 1 mil. The results are the same.

EXAMPLE XIV

The foregoing examples are repeated except that the coating is applied by printing rather than extrusion and the results are the same.

EXAMPLE XV

The foregoing examples are repeated incorporating a dispersing agent for the pigment. The results are the same.

EXAMPLE XVI

The foregoing examples are repeated with a release layer of crystalline wax between the carrier and the transfer layer. The results are the same.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. The method of producing a heat transfer film comprising forming a single layer heat transfer coating consisting of a uniform blend of a pigmented polyolefin and a rosin ester on a carrier film.

2. The method of producing a heat transfer film in accordance with claim 1 wherein the transfer layer is formed from a polyethylene having a molecular weight below about 10,000.

3. The method of preparing a heat transfer film comprising the steps of (a) preparing a dispersion consisting of a low molecular weight polyethylene mixture with a pigment and a rosin ester;

(b) extruding the dispersion on a plastic film;

(c) slitting the film with its extruded layer; and (d) forming rolls of the slittings.

4. The method of preparing a heat transfer film in accordance with claim 3 wherein the rolls are used in forming an imprint on an object.

5. The method of preparing a heat transfer film in accordance with claim 3 wherein an imprint is formed by applying heat to the film with the extruded coating in contact with the object to be imprinted.

6. The method of preparing a heat transfer film in accordance with claim 5 further including the step of mixing the resin or wax with the low molecular weight polyethylene before the pigment is dispersed therein.

7. The method of preparing a heat transfer film in accordance with claim 5 wherein a dye is substituted for the pigment.

8. The method of imprinting the surface of an object comprising the steps of (a) positioning a heat transfer film, including a carrier and a transfer layer thereon, with respect to a surface of the object; (b) bringing a printhead into contact with said film to cause the selective release of the transfer layer onto said surface, said transfer layer consisting of a low molecular weight polyolefin with a dispersed pigment and a rosin ester.

9. The method of claim 8 wherein said printhead is in the form of a type face and said transfer layer is released onto said surface in a printed pattern according to the setting of the type in said type face.

10. The method of claim 8 where said transfer film includes a carrier for said transfer layer and said printhead is brought into contact with said carrier.

11. The method of claim 8 wherein the transfer layer is selectively released on a sheet of flexible material.

12. The method of claim 11 wherein said sheet is a thin film.

* * * * *